US006675713B2

(12) United States Patent
Zeltner

(10) Patent No.: US 6,675,713 B2
(45) Date of Patent: Jan. 13, 2004

(54) ECCENTRIC BELT DRIVE

(75) Inventor: Jürgen Zeltner, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 10 days.

(21) Appl. No.: 10/093,702

(22) Filed: Mar. 8, 2002

(65) Prior Publication Data

US 2002/0124749 A1 Sep. 12, 2002

(30) Foreign Application Priority Data

Mar. 8, 2001 (DE) ..... 101 11 067

(51) Int. Cl.[7] ..... B65G 47/28; B41F 21/00
(52) U.S. Cl. ..... 101/480; 198/459.8; 198/792
(58) Field of Search ..... 198/462.3, 792, 198/459.8; 400/578, 624, 629; 101/480, 494

(56) References Cited

U.S. PATENT DOCUMENTS 3,601,241 A * 8/1971 Kuhnt et al. ..... 198/469.1
6,405,850 B1 * 6/2002 Jackson et al. ..... 198/462.3

FOREIGN PATENT DOCUMENTS

DE 196 53 424 A1 6/1998
DE 100 12 255 A1 10/2000
JP 61-83924 U 6/1986
JP 11059948 A * 3/1999 ..... B65H/5/02

* cited by examiner

*Primary Examiner*—Daniel J. Colilla
(74) *Attorney, Agent, or Firm*—Laurence A. Greenberg; Werner H. Stemer; Gregory L. Mayback

(57) ABSTRACT

A drive device for producing an at least approximately sinusoidal speed pattern for a transport belt provided in a printing machine for transporting printing material selected from the group thereof consisting of sheets and signatures, includes non-round drive wheels rotatable about respective axes thereof, and a tensioning member by which the drive wheels are drivingly connected.

8 Claims, 3 Drawing Sheets

ECCENTRIC BELT DRIVE

BACKGROUND OF THE INVENTION

Field of the Invention

The invention relates to a drive device for producing a sinusoidal speed pattern for a transport belt provided for transporting sheets or signatures in a printing machine.

Speed patterns or vignettes of this type are run, in particular, by transport belts which, in the feeder of a sheet-fed rotary printing machine, feed sheets individually or imbricated, i.e., overlapped, from a sheet pile to the printing machine. In this regard, before the direct transport from the feeding table to the printing machine, the sheet is aligned on so-called front lays or marks. In order that the leading edge of each individual sheet be protected when it engages the front lays, contact therebetween occurs at a low speed of the sinusoidal speed pattern of the transport belt.

For producing such a speed pattern, the Japanese Utility Model (JP-GM) Sho 61-83924 discloses the practice of driving the drive roller of an endless transport belt guided around a further deflection roller by eccentrically mounted gearwheels. In this regard, this Japanese utility model utilizes a gear train having three eccentrically mounted gearwheels. In practice, it is very complicated to align exactly with one another gear wheels which have teeth engaging eccentrically with one another.

SUMMARY OF THE INVENTION

It is accordingly an object of the invention to provide an alternative drive device for producing a sinusoidal speed pattern for a transport belt which avoids the disadvantages of the heretofore known drive devices of this general type.

With the foregoing and other objects in view, there is provided, in accordance with one aspect of the invention, a drive device for producing an at least approximately sinusoidal speed pattern for a transport belt provided in a printing machine for transporting printing material selected from the group thereof consisting of sheets and signatures, comprising non-round drive wheels rotatable about respective axes thereof, and a tensioning member by which the drive wheels are drivingly connected.

In accordance with another aspect of the invention, there is provided a drive device for producing an at least approximately sinusoidal speed pattern for a transport belt provided in a printing machine for transporting printing material selected from the group thereof consisting of sheets or signatures, comprising eccentrically mounted drive wheels having a circular contour and being rotatable about respective axes thereof, a non-round compensating wheel, and a common flexible tensioning member for drivingly connecting the drive wheels and the compensating wheel to one another.

In accordance with another feature of the invention, the compensating wheel is pivotably mounted.

In accordance with a further feature of the invention, the compensating wheel is displaceably mounted.

In accordance with an added feature of the invention, the drive wheels are toothed belt pulleys, and the flexible tensioning member is a toothed belt.

In accordance with a concomitant feature of the invention, the drive wheels are sprockets, and the flexible tensioning member is a chain.

A particular advantage of the invention is that the provided drive wheels do not mesh directly with one another but are drivingly connected only indirectly by a flexible tensioning member such as a toothed belt or chain. As a result of this feature, the quality requirements imposed upon the drive wheels are low, in relation to both the strength and accuracy thereof, because the flexible tensioning member, due to the elasticity thereof, compensates for inaccuracies which may possibly occur. Assembly is likewise quite simple.

In a second exemplary embodiment, provision is made for the drive wheel for the drive roller of the transport belt to be formed round and to be mounted eccentrically, and also to form the drive wheel driven with a single revolution by the printing machine likewise round and to mount it eccentrically. Furthermore, provision is made for a third non-round, ellipse-like deflection wheel, which keeps the common flexible tensioning member always uniformly in tension.

The deflection wheel is mounted so that it can be pivoted or displaced, and therewith also provided at the same time as a tensioning wheel for the flexible tensioning member.

Other features which are considered as characteristic for the invention are set forth in the appended claims.

Although the invention is illustrated and described herein as embodied in an eccentric belt drive, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
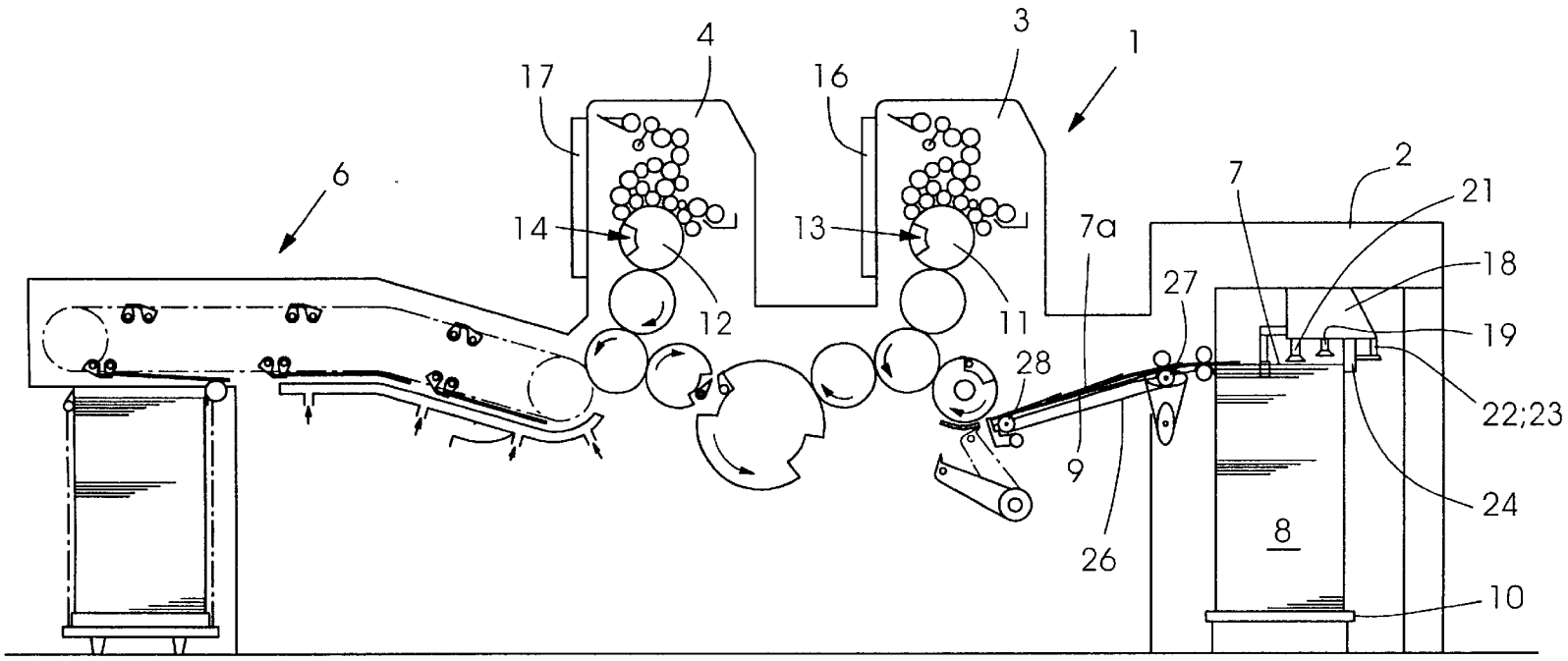
FIG. 1 is a diagrammatic side elevational view of a printing machine incorporating the eccentric belt drive according to the invention.
Figure 2:
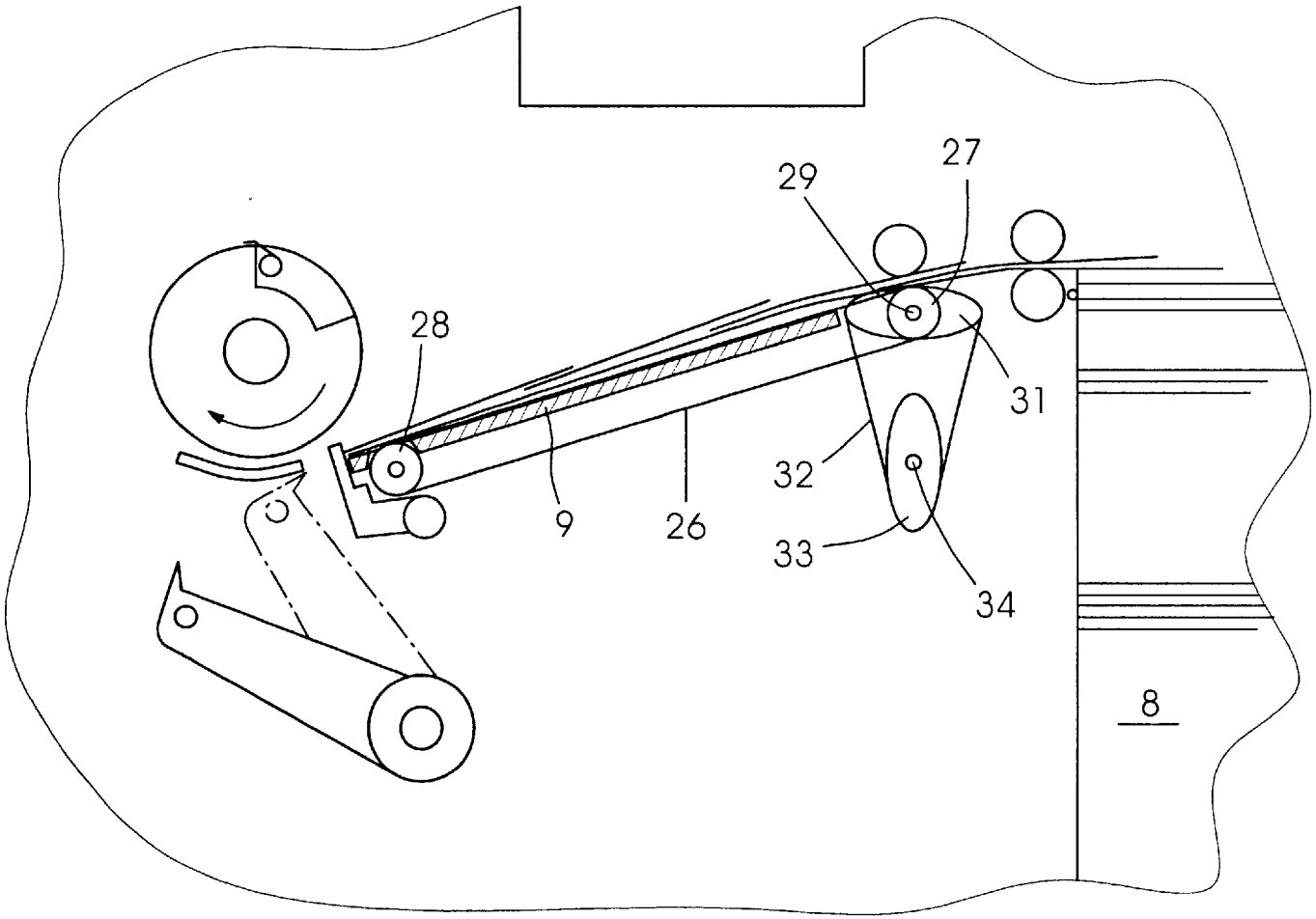
FIG. 2 is an enlarged fragmentary view of FIG. 1, diagrammatically showing a first exemplary embodiment of a drive device according to the invention for a drive roller of a transport belt in a feeder of the printing machine.

Referring now to the drawings and, first, particularly to FIG. 1 thereof, there is shown therein a rotary printing machine, for example, a printing machine 1 for processing sheets 7, having a feeder 2, at least one printing unit 3 and 4, respectively, and a delivery 6. The sheets 7 are removed from a sheet pile 8 and, separated, i.e., singled, or imbricated, i.e., overlapped, are fed via a feed table 9 to the printing units 3 and 4, each of which is provided, in a conventional manner, with a respective plate cylinder 11, 12. The plate cylinders 11 and 12, respectively, have a device 13, 14 for fastening flexible printing plates thereon. Furthermore, to each of the plate cylinders 11 and 12, there is assigned a device 16, 17 for semiautomatically or fully automatically changing the printing plates.

The sheet pile 8 rests on a pile or stacking board 10 which is controllingly liftable. The removal of the sheets 7 takes place from the top of the sheet pile 8, by a so-called suction head 18, which has, amongst others, a number of lifting and dragging suckers 19, 21 for separating or singling the sheets 7. Furthermore, blowing or blast devices 22 for loosening the top sheet layers, and sensing elements 23 for pile tracking are provided. In order to align the sheet pile 8, in particular the upper sheets 7 of the sheet pile 8, a number of side and rear stops are provided.

The feeding table 9 includes, amongst others, at least one transport belt 26 driven by a drive roller 27. The endless transport belt 26 is looped around a deflection roller 28, which is arranged at an end of the feeding table 9. The drive roller 27 has a drive shaft 29 or a shaft end, whereon there is arranged a first non-round, ellipse-like drive wheel 31, in the form of a toothed belt pulley or a sprocket. The drive wheel 31 is drivingly connected, via a flexible tensioning member 32 formed as a toothed belt or chain, to a second non-round, ellipse-like drive wheel 33, which is formed in a manner corresponding to that of the first drive wheel 31.

The second drive wheel 33 is seated on a drive shaft 34 driven in a single revolution by the printing machine. The drive from the printing machine can be effected by a gear train, a longitudinal shaft or a belt drive. A dedicated drive, for example in the form of an electric motor, is likewise possible.

The drive wheels 31 and 32 have an at least approximately elliptical shape and are arranged offset 90° from one another. The drive wheel 33 driven uniformly by the printing machine drives the drive wheel 31 via the flexible tensioning member 32 and therefore transmits a sinusoidal speed to the drive shaft 27 of the transport belt 26.

Figure 3:
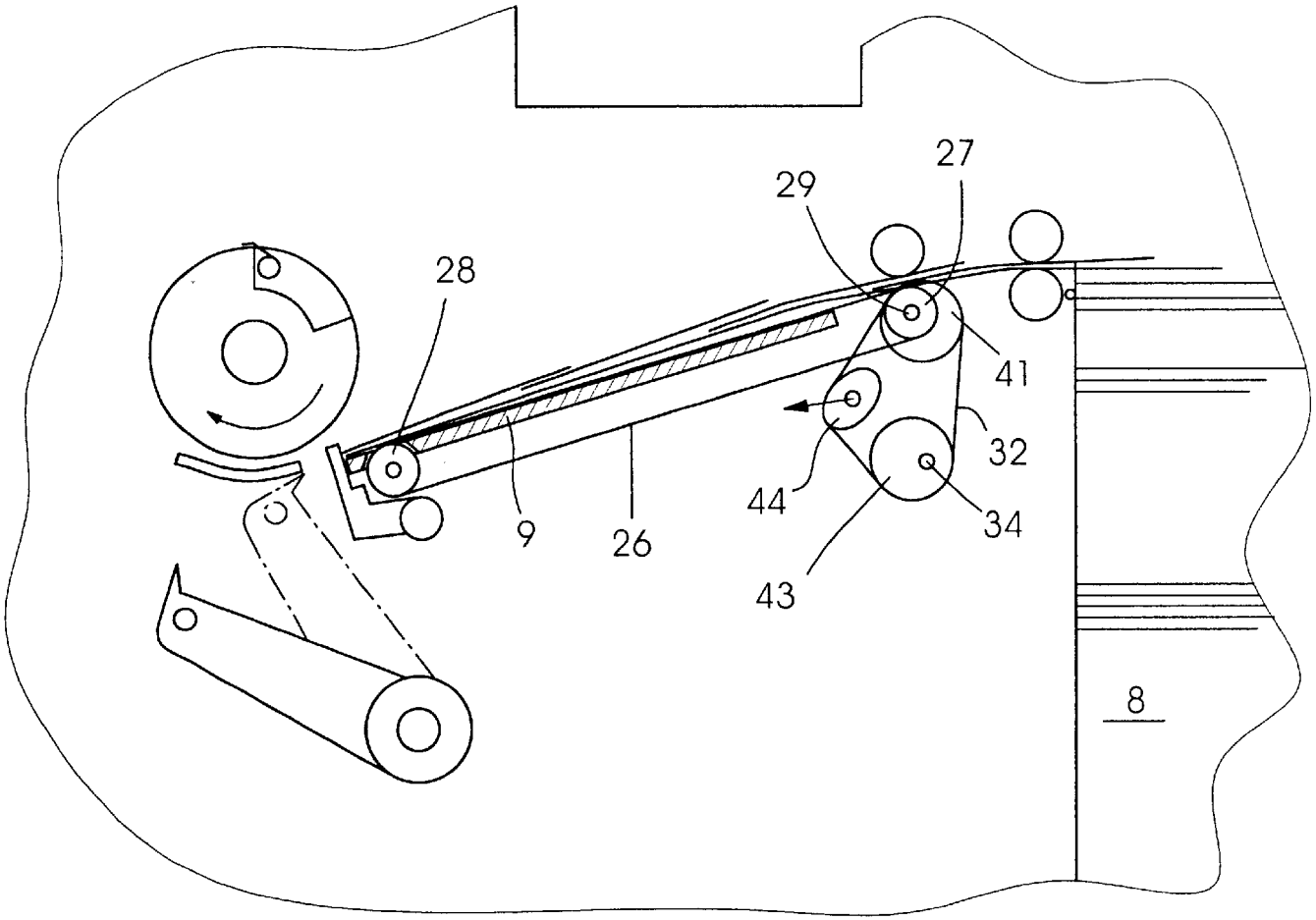
FIG. 3 is a view like that of FIG. 2 of a second exemplary embodiment of the drive device.

In a second exemplary embodiment, according to FIG. 3, the drive roller 27 has a round, eccentrically arranged drive wheel 41, which is seated on the drive shaft 29. By the flexible tensioning member 32, the drive wheel 41 is drivingly connected to a round drive wheel 43 seated eccentrically on the single-revolution drive shaft 34. The flexible tensioning member 32 is additionally looped around a non-round rotatable compensating wheel 44, which is mounted so as to be pivotable or displaceable. The compensating wheel 44 keeps the tension of the flexible tensioning member 32 constant in every angular position of the drive wheels 41 and 43. Retensioning of the flexible tensioning member 32 is performed by an adjustment of the compensating wheel 44. In addition, the drive wheels 41 and 43 and the compensating wheel 44 are formed either as toothed belt pulleys or sprockets.

The exact contour of the wheels is configured so that, when the drive wheel 33 is running uniformly, the drive wheel 31 has an at least approximately sinusoidal speed pattern, and the drive belt always remains uniformly in tension.

I claim:

1. In a printing machine having a transport belt for transporting printing material, a drive device for producing an at least approximately sinusoidal speed pattern for the transport belt, the drive device comprising:

eccentrically mounted drive wheels having a circular contour and respective axes and being rotatable about said respective axes, a non-round compensating wheel, and a common flexible tensioning member for drivingly connecting said drive wheels and said compensating wheel to one another.

2. The drive device according to claim 1, wherein said compensating wheel is pivotably mounted.

3. The drive device according to claim 1, wherein said compensating wheel is displaceably mounted.

4. The drive device according to claim 1, wherein said drive wheels are toothed belt pulleys, and said flexible tensioning member is a toothed belt.

5. The drive device according to claim 2, wherein said drive wheels are sprockets, and said flexible tensioning member is a chain.

6. The drive device according to claim 1, configured to transport printing material in the form of sheets on the transport belt.

7. The drive device according to claim 1, configured to transport printing material in the form of signatures on the transport belt.

8. In a printing machine having a transport belt for transporting printing material, a drive device for producing an at least approximately sinusoidal speed pattern for the transport belt, the drive device comprising:

eccentrically mounted drive sprockets having a circular contour and respective axes and being rotatable about said respective axes, a non-round compensating wheel, and a common chain for drivingly connecting said drive sprockets and said compensating wheel to one another.

* * * * *